US005415109A

United States Patent [19]

McBride

[11] Patent Number: 5,415,109

[45] Date of Patent: May 16, 1995

[54] HAND TRUCK PALLET HAVING A NON-SKID SURFACE

[76] Inventor: Michael M. McBride, 4793 Cerny Rd., Pensacola, Fla. 32526-2754

[21] Appl. No.: 214,246

[22] Filed: Mar. 17, 1994

[51] Int. Cl.[6] ..... B65D 19/00

[52] U.S. Cl. ..... 108/51.1

[58] Field of Search ..... 108/51.1, 55.3, 53.1

[56] References Cited

U.S. PATENT DOCUMENTS

| | | | |
|---|---|---|---|
| 688,023 | 12/1901 | Lincoln . | |
| 1,337,005 | 4/1920 | Drumm | 108/51.1 |
| 2,420,625 | 5/1947 | Stalnaker | 108/53.1 |
| 2,481,233 | 9/1949 | Morset | 108/55.3 |
| 3,430,585 | 3/1969 | Grant et al. | 108/51.1 |
| 3,677,200 | 8/1972 | Corragna . | |
| 3,759,192 | 9/1973 | Oehler | 108/51.1 |
| 3,762,344 | 10/1973 | Chez | 108/51.1 |
| 3,848,546 | 11/1974 | Lawlor | 108/55.3 |
| 3,911,182 | 10/1975 | Lieberman | 108/51.1 |
| 4,051,787 | 10/1977 | Nishitani et al. . | |
| 4,198,912 | 4/1980 | Gramckow | 108/51.1 |
| 4,714,026 | 12/1987 | Yamaguchi et al. | 108/51.1 |
| 4,841,879 | 6/1989 | Ferguson | 108/51.1 |

FOREIGN PATENT DOCUMENTS

| | | | |
|---|---|---|---|
| 588387 | 5/1977 | Switzerland | 108/51.1 |
| 1414638 | 11/1975 | United Kingdom | 108/51.1 |

*Primary Examiner*—Kenneth J. Dorner
*Assistant Examiner*—Janet M. Wilkens
*Attorney, Agent, or Firm*—Peter Loffler

[57] ABSTRACT

A pallet to be used with a hand truck is provided. The pallet is fabricated from a lightweight and durable material. The pallet comprises a base, a first supporting leg, a second supporting leg, and a cross member. The first and second supporting legs are attached to the bottom surface of the base. The cross member joins the two legs. The top surface of the base is fabricated to have a high coefficient of friction to prevent cargo items located on the pallet from slipping or slipping. The bottom surface of the first supporting leg, second supporting leg, and cross member are constructed so as to posses non-scuff properties.

8 Claims, 4 Drawing Sheets

HAND TRUCK PALLET HAVING A NON-SKID SURFACE

BACKGROUND OF THE INVENTION

1. Field of the Invention

The present invention relates to a pallet for use with a hand truck with the pallet having a non-skid upper surface and legs that will not scuff a floor's surface.

2. Description of the Prior Art

Soda, beer, canned goods, fruit, and other similar products are generally shipped to retailers in cases or crates. A typical method of delivery will be to load the cases onto a truck, ship them to the retailer, unload the truck, move the cases via a hand truck inside, and stack and store the cases. This is a straightforward procedure. However, several problems can occur along the way.

When the cases are unloaded from the delivery truck, they are sometimes placed on the pavement outside the retailer's delivery door before being moved inside. When so placed, the cases come in contact with dirt, oil and other debris on the pavement. The cases are then taken inside complete with the newly gained contaminants. Furthermore, cases stacked on the floor inside will tend to absorb spills that are subsequently occasioned.

These contaminants cause several problems. Oil and water contamination will weaken the case. When an employee lifts a case, the bottom will give out resulting in a mess. Adding to the mess will be the oil deposited on the floor where the cases are stacked and then removed. This oil will contaminate subsequent cases that are stored there. As cases are rotated from bottom to top, the contaminated bottom surface of the top cases will contaminate those cases below upon which they are stacked upon.

This case and floor contamination will be passed on to the products within the case. Fruits and vegetables so contaminated, will need to be disposed of. Bottles and cans will be unsightly and will drive customers away. Also oil in the back room will pose a slip and fall potential for employees.

A secondary problem associated with the movement of cases and crates is experienced when the cases are moved by the hand truck. In order to slip a hand truck underneath a stack of cases, the stack must be tilted. As one person is tilting the stack and maneuvering the hand truck, the potential to tilt the stack too far exists. Tilting the stack too far will not only cause a case spill but may result in injury to the hand truck user. A second person is needed in order to make the operation safe, however, a second person is not always to be found.

What is needed is a device that will prevent cases and crates from becoming dirty from ground contaminants during the shipping process. This device must also be able to store the cases and protect them from spills inside the storage room. The device must provide a single user the ability to safely lift cases by a hand truck.

Towards these ends, a pallet for use with a hand truck is proposed. Although pallets for fork lift use are well known in the art, hand truck pallets, as proposed by the present invention, are a new entry.

SUMMARY OF THE INVENTION

The present invention provides for a pallet that is to be used with hand trucks. The present invention provides for a pallet that is constructed from a lightweight and durable material that has a non-skid surface on the case engagement surface, and a non-scuff surface on the floor engagement surfaces.

The pallet of the present invention consists of a top surface, two side legs and a cross member joining the two side legs. The top surface is substantially planar and includes a surface that has a high coefficient of friction. As the surface possesses a high coefficient of friction, cargo items will be more secure when loaded onto and moved via the pallet.

The legs of the pallet will be constructed so that they do not scuff the floor. This will be accomplished by constructing the pallet, or at least those portions contacting the floor, from a non-scuff material such as wood, plastic, or rubber. Alternatively, a non-scuff coating can be attached to the legs to prevent scuffing.

Therefore, it is the object of the present invention to provide for a pallet that is constructed from a material that is durable and lightweight.

It is another object of the present invention to provide for a pallet that has a surface possessing a high coefficient of friction.

It is another object of the present invention to provide for a pallet that is used with hand trucks.

It is another object of the present invention to provide for a pallet that is durable in operation and economical to fabricate.

It is a final object of the present invention to provide for a pallet that will permit the movement and storage of cases and crates, whereby the cases and crates need not come in contact with the ground.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
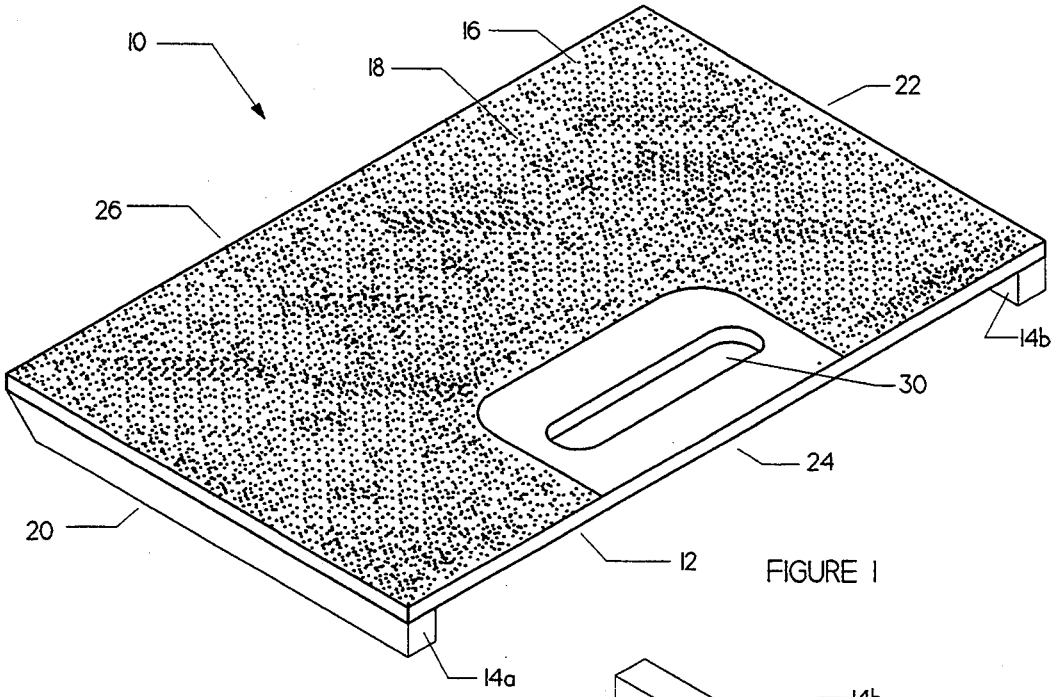
FIG. 1 is a top perspective view of the pallet of the present invention.
Figure 2:
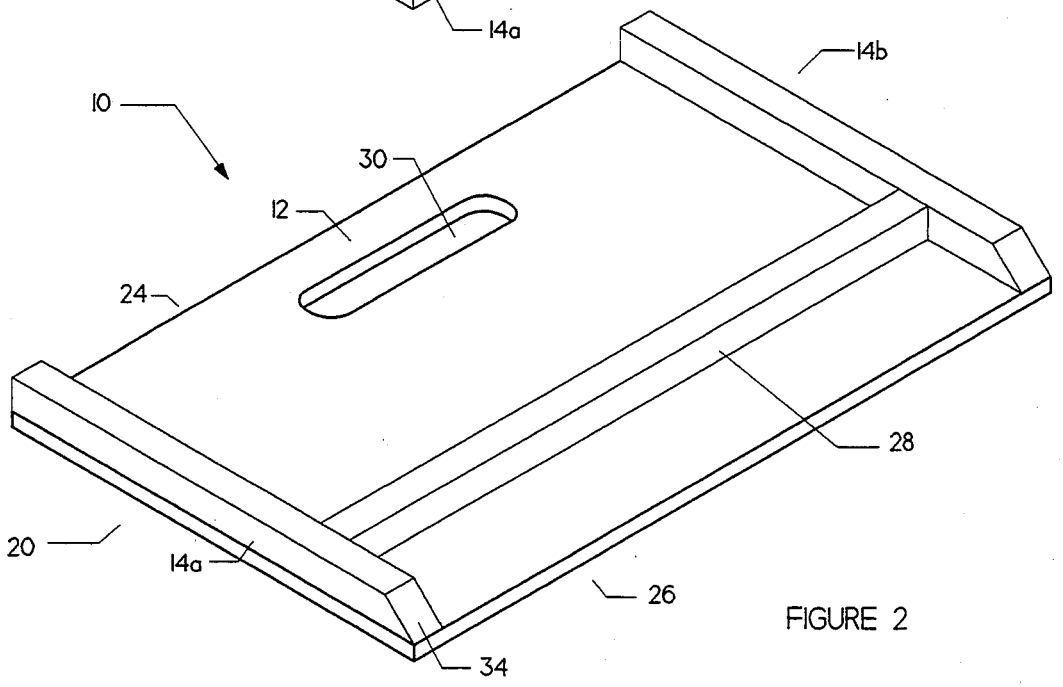
FIG. 2 is a bottom perspective view of the pallet of the present invention.
Figure 3:
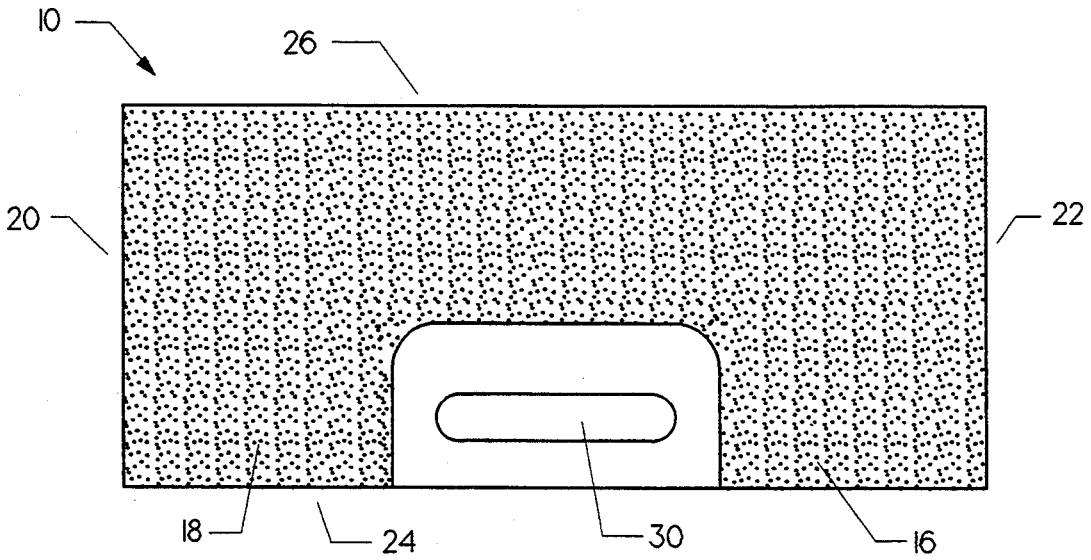
FIG. 3 is a top plan view of the pallet of the present invention.
Figure 4:
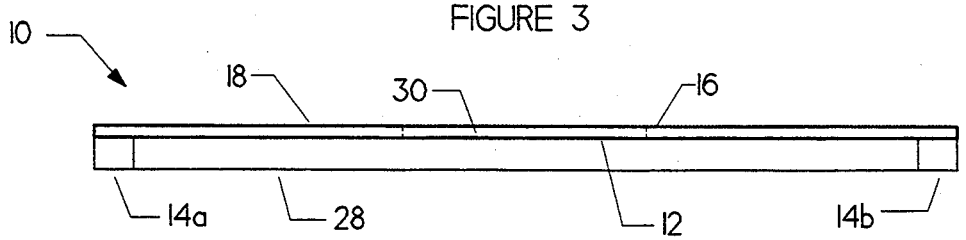
FIG. 4 is an elevational front view of the pallet of the present invention.
Figure 5:
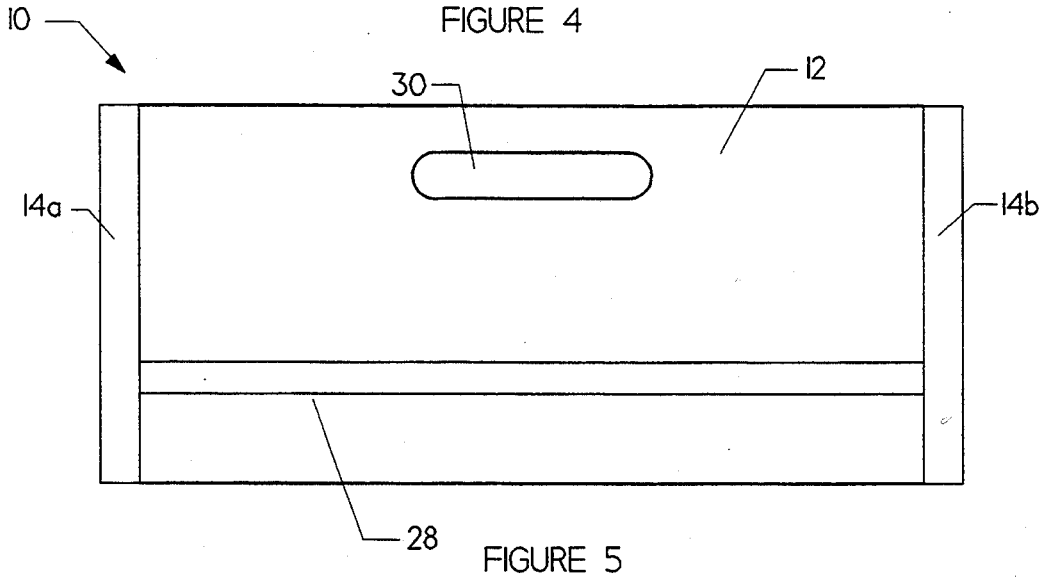
FIG. 5 is a bottom plan view of the pallet of the present invention.
Figure 6:
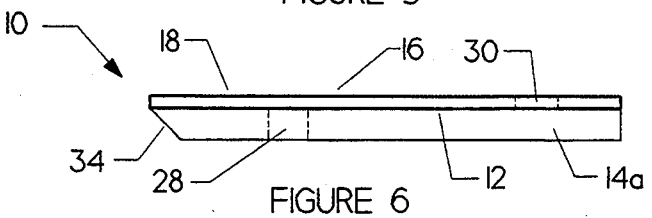
FIG. 6 is a elevational side view of the pallet of the present invention.

FIGS. 1–3 are various views of the pallet of the present invention. As illustrated in these figures, the pallet 10 consists of a base 12 and two legs 14*a* and 14*b*.

The base 12 has an upper surface 16 which is substantially planar and is constructed to have a rectangular configuration. This planar upper surface and rectangular configuration will allow the pallet to accommodate and hold various cases and crates and other similar cargo items.

The upper surface 16 of the pallet has a high coefficient of friction. By having a high coefficient of friction, the upper surface of the pallet will possess non-skid characteristics. By having a non-skid surface, the cases placed on the pallet will not slip or slide when the pallet is tilted or moved.

Figure 7:
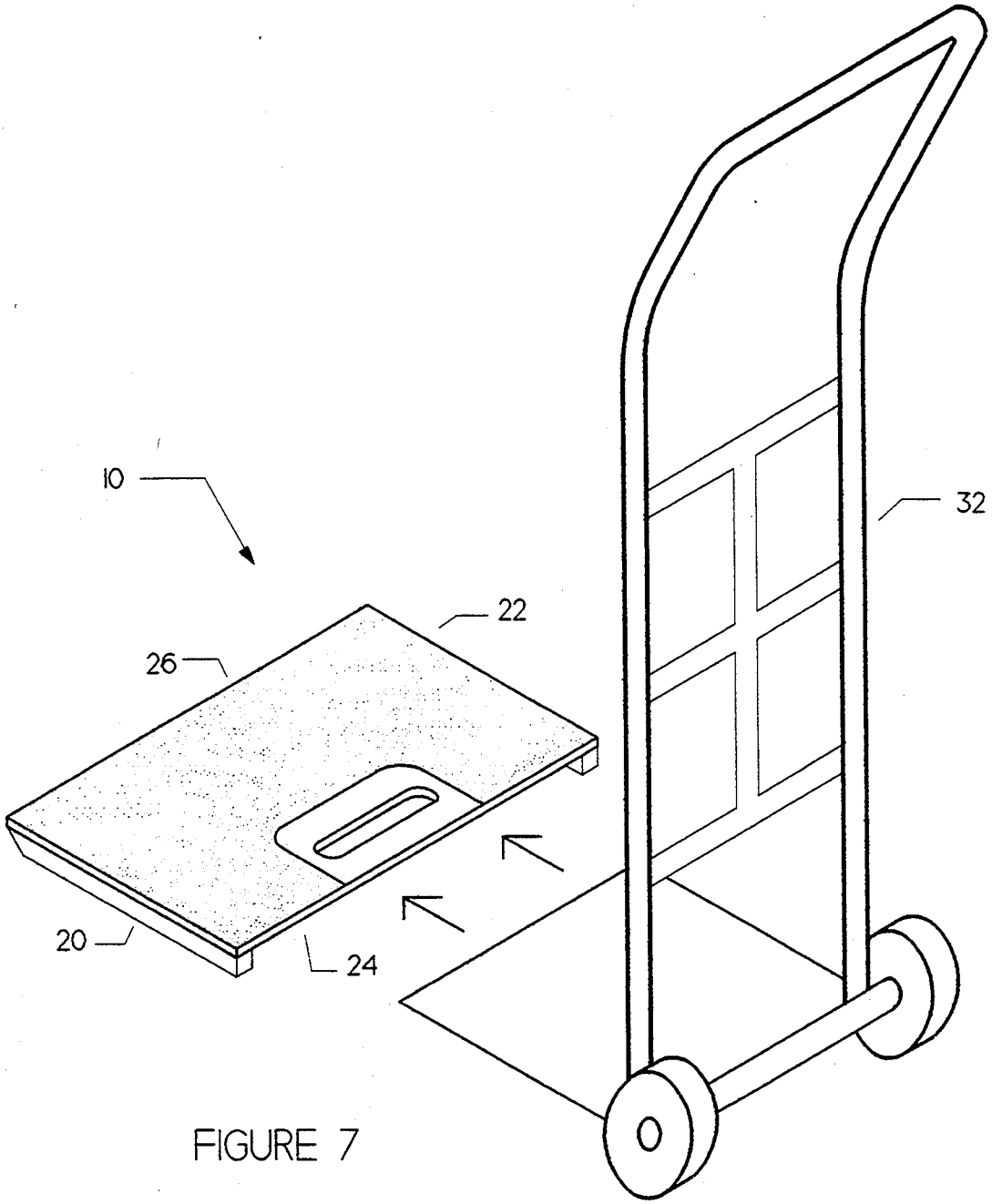
FIG. 7 is an elevational side view of the pallet of the present invention being utilized with a hand truck.

There are several ways to provide the upper surface with a high coefficient of friction. If the upper surface is made of plastic or wood, a coat of paint can be applied to the surface. While the paint is still wet, a layer of coarse sand can be sprayed onto the surface. When the paint dries, the sand will remain affixed to the upper surface. The sand will provide the requisite high coefficient of friction. The pallet with a sand coated surface 18 is illustrated in FIGS. 1, 3, and 7. Alternatively, an adhesive can be used in a similar manner to adhere the sand.

Figure 8:
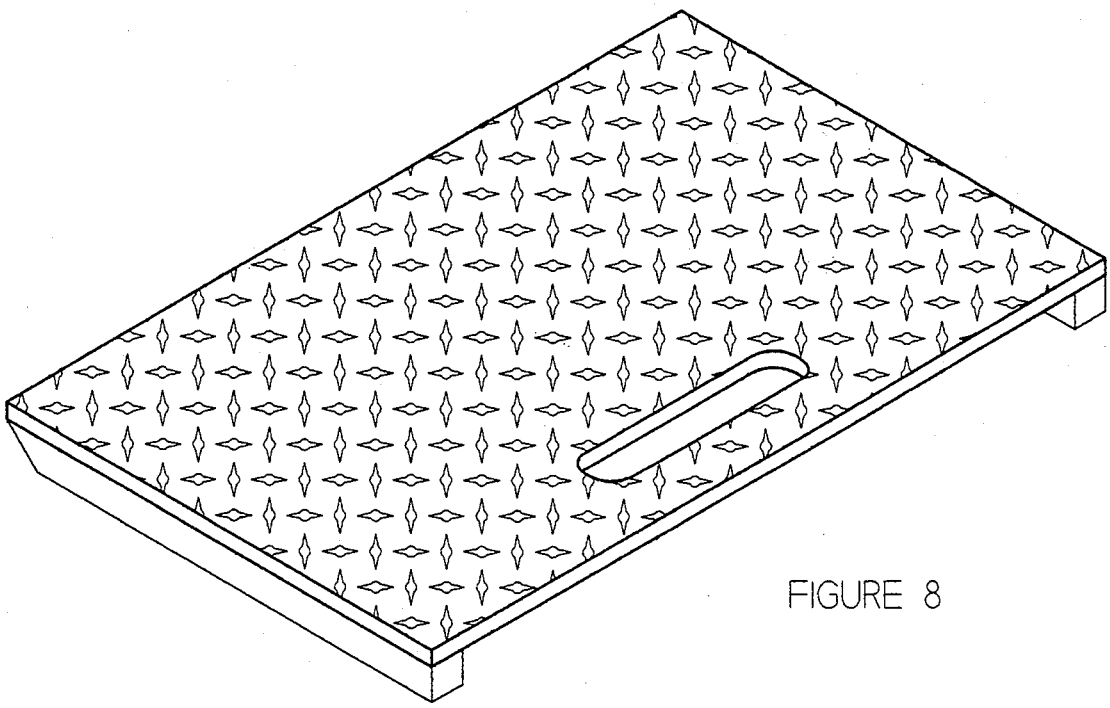
FIG. 8 is a top perspective view of the pallet of the present invention possessing a thread plate non-skid surface.

A second method to provide an upper surface with a high coefficient of friction is illustrated in FIG. 8. As seen in this figure, the top surface of the pallet is provided with a thread plate design such as an aluminum thread plate. This thread plate design provides the upper surface of the pallet to be roughened, thereby causing it to have a high coefficient of friction.

A further means of providing the upper surface with a high coefficient of friction is to permanently affix a layer of resilient material on the upper surface of the base.

The base 12 also has a bottom surface (not illustrated), a first edge 20, second edge 22, third edge 24, and fourth 26 edge. As seen in FIG. 1, the first and second edges, are parallel to one another, while the third and fourth edges are parallel to each other. The first and second edges of the base have a width of 12 inches. The third and fourth edges of the base have a length of 22 inches.

Attached to the bottom surface and aligned with the first edge 20 is a first leg 14*a*. Attached to the bottom surface and aligned with the second edge 22 is a second leg 14*b*. The first leg 14*a* is identical is shape, design and configuration to the second leg 14*b*. The first leg and second leg are parallel to each other. The first and second legs provide the appropriate elevation for the pallet so that a hand truck can be slid underneath the pallet.

The first and second legs have a rectangular cross section. The length of each leg is 12 inches and the width of each leg is 1 inch. This provides an adequate gap (20 inches) between the legs in order to accommodate any conventional hand truck (usually requiring a gap of 14–18 inches). The final height of the pallet (base plus legs) is 1.5 inches.

The back end of each leg, that end that will be distal to the hand truck, is tapered 34. This tapered end 34 will have a slope of approximately thirty to forty-five degrees relative to the horizon. This tapered end will prevent the floor from being scuffed by the pallet when the pallet is tilted back onto the hand truck.

A cross support member 28 is attached to the bottom surface of the base at a location which is proximate to the forth edge 26 of the base and distal to the third edge of the base and which extends from the first leg to the second leg. The cross support member provides additional support and structural integrity so that the pallet can hold a heavy load.

The first leg, second leg, and cross support member can be made entirely of a polymer, such as natural rubber, soft rubber, or neoprene rubber. Alternatively, the first leg, second leg, and cross support member can be coated or covered with a polymer layer. This polymer layer provides a non-scuff property to the legs and protects a floor's surface when the pallet is placed onto or moved about the floor. The polymer layer also possesses non-skid characteristics and helps keep the pallet secure on the floor.

Located on the upper surface and extending to the bottom surface of the pallet 10 is an aperture 30. This aperture acts as a means for hand carrying the pallet.

The pallet can be constructed from any lightweight and durable material, such as but not limited to: wood, plastic, or metal or metallic material such as aluminum. If the pallet is constructed from metal, it can be coated with an anti-rust finish. The anti-rust finish on the pallet can be accomplished by any conventional means such as a chemical process, hot dipping, or heat finishing.

In order to utilize the pallet of the present invention, cases and crates are stacked on the pallet. The hand truck 32 is inserted between the two legs (see FIG. 7). The cases are tilted backed onto the hand truck and are then easily and conveniently transported. As the back of each leg has a tapered end, the legs will not scuff the floor when the pallet is tilted back onto the hand truck. Once the stacked cases reach their intended destination, they can be stored on the pallet indefinitely.

While the invention has been particularly shown and described with reference to embodiments thereof, it will be understood by those skilled in the art that various changes in form and detail, including any stated dimensions, may be made without departing from the spirit and scope of the invention.

I claim:

1. A pallet used with a hand truck comprising:

a rectangular base;

said rectangular base has a top surface and a bottom surface;

said top surface faces upward and said bottom surface faces downward;

said top surface is parallel to said bottom surface;

said rectangular base has a first edge, a second edge, a third edge and a fourth edge;

said first edge is parallel to said second edge;

said third edge is parallel to said fourth edge;

a first elongated leg and a second elongated leg;

said first elongated leg is permanently and rigidly attached to said bottom surface of said rectangular base;

said second elongated leg is permanently and rigidly attached to said bottom surface of said rectangular base;

said first elongated leg and said second elongated leg are parallel to each other;

said first elongated leg and said second elongated leg both have a rectangular cross section;

said first elongated leg has a first side, a second side, a third side, a fourth side, a fifth side and a sixth side;

said first side is parallel to said second side;

said third side is parallel to said fourth side;

said fifth side is parallel to said sixth side;

said first side of said first elongated leg is attached to said bottom surface of said rectangular base;

said second elongated leg has a first end, a second end, a third end, a fourth end, a fifth end, and a sixth end;

said first end is parallel to said second end;

said third end is parallel to said fourth end;

said fifth end is opposite said sixth end;

said first end of said second elongated leg is attached to said bottom surface of said rectangular base;

said third side of said first elongated leg is aligned with said first edge of said rectangular base;

said fifth side of said first elongated leg is aligned with said third edge of said rectangular base;

said sixth side of said first elongated leg is aligned with said fourth edge of said rectangular base;

said fourth end of said second elongated leg is aligned with said second edge of said rectangular base;

said fifth end of said second elongated leg is aligned with said third edge of said rectangular base;

said sixth end of said second elongated leg is aligned with said fourth edge of said rectangular base;

said fourth side of said first elongated leg faces said third end of second elongated leg.

a cross support member;

said cross support member has a rectangular cross section;

said cross support member is attached to said bottom surface of said rectangular base at a location which is proximate to said forth edge of said rectangular base and distal to said third edge of said rectangular base;

said cross support member further includes a first end and a second end;

said first end of said cross support member is attached perpendicularly to said fourth side of said first elongated leg; and said second end of said cross support member is attached perpendicularly to said third end of said second elongated leg.

2. The pallet as in claim 1 wherein an elongated through-hole is located on said top surface and extends through to said bottom surface of said rectangular base; and said elongated through-hole provides a means of carrying said pallet.

3. The pallet as in claim 1 wherein said first elongated leg, said second elongated leg, and said cross support member are coated with a rubber material.

4. A pallet as in claim 1 wherein said cross support member has a top plane and a bottom plane;

said top plane is attached to said bottom surface; and said bottom surface, said second side of said first elongated leg, and said second end of said second elongated leg are each affixed with a polymer layer.

5. A pallet as in claim 1 wherein the width of said first edge and said second edge of said rectangular base, the length of said third side and said fourth side of said first elongated leg, and the length of said third end and said fourth end of said second elongated leg are each 12 inches in width; and said third edge and said fourth edge of said rectangular base are each 22 inches in length.

6. A pallet as in claim 1 wherein said top surface has a roughened texture;

said roughened texture provides for said top surface to have a high coefficient of friction.

7. A pallet as in claim 6 wherein said roughened texture consists of sand adhered to said top surface.

8. A pallet as in claim 6 wherein said roughened texture consists of a thread plate design impressed upon said top surface.

* * * * *